US011643289B2

(12) United States Patent
Nakagawa

(10) Patent No.: US 11,643,289 B2
(45) Date of Patent: May 9, 2023

(54) SHEET FEEDING APPARATUS AND IMAGE FORMING APPARATUS

(71) Applicant: CANON KABUSHIKI KAISHA, Tokyo (JP)

(72) Inventor: Hiroyuki Nakagawa, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 4 days.

(21) Appl. No.: 16/864,347

(22) Filed: May 1, 2020

(65) Prior Publication Data

US 2020/0354177 A1 Nov. 12, 2020

(30) Foreign Application Priority Data

May 10, 2019 (JP) ..... JP2019-089433

(51) Int. Cl.
*B65H 3/52* (2006.01)
*B65H 3/06* (2006.01)

(52) U.S. Cl.
CPC ..... *B65H 3/0684* (2013.01); *B65H 3/0676* (2013.01); *B65H 3/5261* (2013.01)

(58) Field of Classification Search
CPC ... B65H 3/0676; B65H 3/0684; B65H 3/5261
See application file for complete search history.

(56) References Cited

U.S. PATENT DOCUMENTS 5,451,043 A * 9/1995 Arai ..... B65H 3/5215 271/121
9,242,820 B2 * 1/2016 Machii ..... B65H 3/0676
2020/0017324 A1 * 1/2020 Aoki ..... B65H 3/5261

FOREIGN PATENT DOCUMENTS

JP 2006-315827 A 11/2006
JP 2014-185000 A 10/2014
JP 2015-120572 A 7/2015
JP 2017071478 A * 4/2017

* cited by examiner

*Primary Examiner* — Howard J Sanders
(74) *Attorney, Agent, or Firm* — Venable LLP

(57) ABSTRACT

A sheet feeding apparatus includes a swing shaft to swingably support a support member, an urging member to urge a rotary separation member toward a rotary feeding member, a frame member including a first support portion to fix a first end portion of the swing shaft and a second support portion to movably support a second end portion of the swing shaft, and an adjustment mechanism having an extended opening formed in the second support portion and a fixing member configured to fix the second end portion of the swing shaft to a frame member through the extended opening. The extended opening is extended in a vertical direction and the second end portion of the swing shaft can be fixed at a plurality of positions which vary in the vertical direction to the second support portion with the fixing member.

13 Claims, 11 Drawing Sheets

SHEET FEEDING APPARATUS AND IMAGE FORMING APPARATUS

BACKGROUND OF THE INVENTION

Field of the Invention

The present invention relates to a sheet feeding apparatus to feed a sheet and an image forming apparatus.

Description of the Related Art

Generally, an image forming apparatus such as a copy machine, a printer, a facsimile, and a composite machine having a plurality of these functions includes a sheet feeding unit to feed a sheet stored in a feed cassette to an image forming unit. Also, the sheet feeding unit described above includes a separation conveyance unit to convey the sheet with separating the sheet from another sheet so as not to feed 2 or more overlapping sheets.

The separation conveyance unit which includes a feed roller synchronously rotating in the same direction with a pickup roller and includes a retard roller being in a pressure contact with the feed roller with a predetermined force of the pressure contact (hereinafter referred to as "retard pressure") is hitherto known. For example, Japanese Patent Laid-Open No. 2014-185000 discloses the separation conveyance unit in which the retard roller is supported in a manner of being capable of swinging freely by an arm member and the retard roller is in the pressure contact with the feed roller with a predetermined retard pressure provided by an urging member.

Incidentally, the retard pressure described above is one of parameters which affect a sheet separation performance at the separation conveyance unit, and control of these parameters are important to obtain a stable separation performance at the separation conveyance unit. In this regard, as the feed roller is driven via a torque limiter in a configuration disclosed in Japanese Patent Laid-Open No. 2014-185000 described above, the arm member is pressed in a pivoting direction of the arm member by a torque given by the torque limiter, and moves the retard pressure upwards and downwards. An amount of an increase and decrease in the retard pressure changes with relative positional relations among the feed roller, the retard roller and a swing shaft. Therefore, when these positions changes, the retard pressure changes, and it becomes difficult to obtain the stable separation performance.

Accordingly, variance in the retard pressure has been conventionally inhibited by reducing the variance in the positions as much as possible by means of improving accuracy of a component and assembly. Also, for a case where feeding of a plurality of sheets in overlapping occurs, an adjustment of an urging force of a spring used as the urging member of the retard roller is suggested (refer to Japanese Patent Laid-Open No. 2006-315827).

However, even if the accuracy of the component and the assembly is improved, the variance of the relative positional relations among the feed roller, the retard roller, and the swing shaft of the retard roller may affect the retard pressure due to dimensional tolerance of the component and the variance in the assembly.

SUMMARY OF THE INVENTION

According to one aspect of the invention, a sheet feeding apparatus includes a sheet supporting portion configured to support a sheet, a rotary feeding member configured to feed the sheet supported on the sheet supporting portion, a rotary separation member configured to abut on the rotary feeding member and form a separation nip in which the sheet is conveyed with separation from another sheet, a support member configured to support a rotation shaft of the rotary separation member, a swing shaft configured to support the support member with the support member being swingable, an urging member configured to urge the rotary separation member toward the rotary feeding member, a frame member including a first support portion configured to fix a first end portion of the swing shaft and a second support portion configured to movably support a second end portion of the swing shaft, and an adjustment mechanism including a long hole formed in the second support portion and a fixing member configured to fix the second end portion of the swing shaft to the frame member. The second end portion of the swing shaft can be fixed at a plurality of positions to the second support portion with the fixing member.

Further features of the present invention will become apparent from the following description of exemplary embodiments with reference to the attached drawings.

DESCRIPTION OF THE EMBODIMENTS

An image forming apparatus according to embodiments of the present invention will be described below. However, it should be noted that sizes, materials, shapes, relative arrangements, and the like of components set forth in these embodiments are to be appropriately changed depending on configurations and various conditions of an apparatus to which the present invention is applied, and do not limit the scope of the present invention unless it is specifically stated otherwise.

First Embodiment

Figure 1:
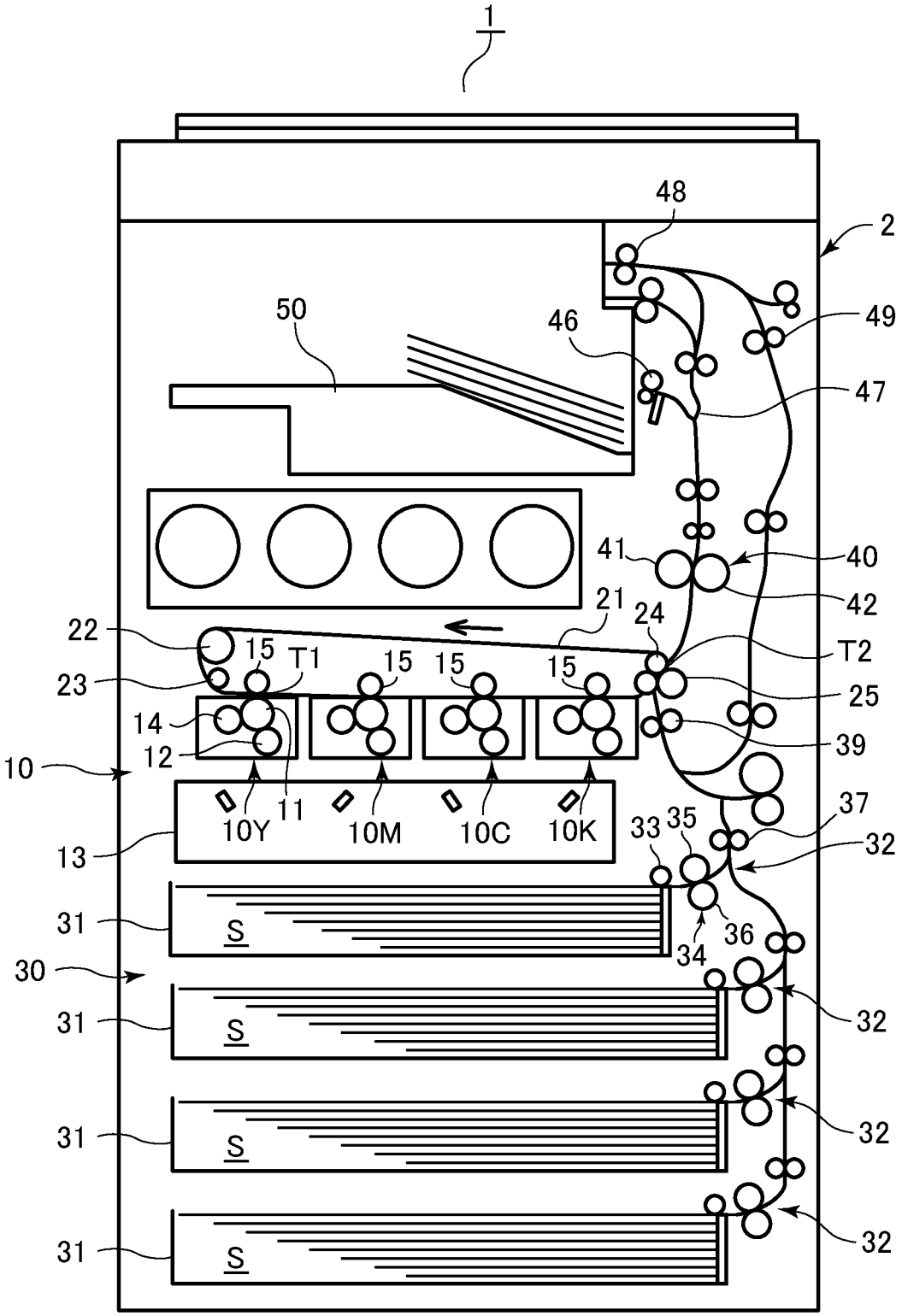
FIG. 1 is a drawing showing an image forming apparatus according to a first embodiment.

A printer 1 according to a first embodiment of the present invention is, as illustrated in FIG. 1, an image forming apparatus including a so-called intermediate transfer tandem type image forming unit 10 including 4 process cartridges 10Y, 10M, 10C, and 10K inside an apparatus body 2. The printer 1 forms and outputs an image on a sheet S based on an image information read from a document and input from an external apparatus. To be noted, the sheet S is a recording medium which includes, other than a standard paper, a special paper such as a coated paper, a recording material of a special shape such as an envelope and an index sheet, a plastic film used for an overhead projector, a cloth, and the like. Also, the document is an example of the sheet S, and may be a blank sheet of paper, or with single-sided or double-sided image formation thereon.

The process cartridges 10Y, 10M, 10C, and 10K are the image forming units to form toner images of yellow (Y), magenta (M), cyan (C), and black (K), respectively. As structures of the process cartridges are basically same except for colors of stored toners, the structure of the process cartridge 10Y of yellow is described below as a representative.

The process cartridge 10Y includes a photosensitive drum 11, a charge unit 12, a developing unit 14, and a cleaning unit. Also, an exposing unit 13 capable of scanning the photosensitive drum 11 based on the image information is arranged inside the apparatus body 2. When an image forming process starts, the photosensitive drum 11 is drivingly rotated, and a surface of the photosensitive drum 11 is uniformly charged by the charge unit 12. Thereafter, an electrostatic latent image is formed on the photosensitive drum 11 by the exposing unit 13. The electrostatic latent image formed on the photosensitive drum 11 is visualized (developed) to a toner image by a toner supplied from the developing unit 14.

In the image forming unit 10, an intermediate transfer belt 21, which is an intermediate transfer member, is arranged, and is wound around a driving roller 22, a tension roller 23, and a secondary transfer inner roller 24. The intermediate transfer belt 21 is, with being moderately stretched by the tension roller 23, drivingly rotated by the driving roller 22 in a direction which follows rotation of the photosensitive drum 11.

On an inner circumference of the intermediate transfer belt 21, a primary transfer roller 15 is arranged facing each of the photosensitive drum 11 of the process cartridges 10Y, 10M, 10C, and 10K. The toner image formed on each of the photosensitive drums 11 is primarily transferred to the intermediate transfer belt 21 at a primary transfer portion T1 formed between the primary transfer roller 15 and the photosensitive drum 11 in a manner of superimposing each other. To be noted, extraneous matter, such as a transfer residual toner, remaining on the photosensitive drum 11 after passing the primary transfer portion T1 is removed by a belt cleaning unit.

On a circumference of the intermediate transfer belt 21, a secondary transfer roller 25 is arranged facing the secondary transfer inner roller 24 across the intermediate transfer belt 21. The toner image born and carried on the intermediate transfer belt 21 is collectively transferred to the sheet S at a secondary transfer portion T2 formed between the secondary transfer roller 25 and the secondary transfer inner roller 24, and the toner image is formed on the sheet S. To be noted, the extraneous matter, such as the transfer residual toner, remaining on the intermediate transfer belt 21 after passing the secondary transfer portion T2 is removed by the belt cleaning unit.

In parallel with the image forming process as described above, a sheet feeding unit 30 provided in the apparatus body 2 performs a feeding process to feed the sheet S to the image forming unit 10. The sheet feeding unit 30 as a sheet feeding unit includes at least one feed cassette 31, and a feeding unit 32 provided for each feed cassette 31. The feed cassette 31 serving as a sheet supporting portion includes a sheet supporting portion 31*a* (refer to FIG. 3) which is capable of ascending and descending, and maintains an uppermost sheet at an appropriate height by ascending and descending the sheet supporting portion 31*a*.

The feeding unit 32 includes a pickup roller 33 abutting on the uppermost sheet of the sheet S stored on the feed cassette 31 and sending out the sheet S, and includes a pair of separation rollers 34 arranged on a downstream side of the pickup roller 33 in a sheet conveyance direction. The pair of the separation rollers 34 include a feed roller 35, which rotates in the same direction as the pickup roller 33, and a retard roller 36, which is drivingly rotated in a reverse direction to the sheet conveyance direction in a case of the sheet being fed in overlapping. Also, the pair of the separation rollers 34 convey the sheets along the sheet conveyance direction with separating the sheet delivered by the pickup roller 33 into one by one at a separation nip 34N formed between the feed roller 35 and the retard roller 36 (refer to FIG. 3).

The sheet S fed by the sheet feeding unit 30 is delivered to a pair of registration rollers 39 arranged immediately in front of the secondary transfer portion T2. The pair of the registration rollers 39 correct sheet skew, and also convey the sheet S to the secondary transfer portion T2 in synchronizing with a progress of the image forming process at the image forming unit 10.

The sheet S with an unfixed toner image transferred at the secondary transfer portion T2 is delivered to a fixing unit 40. The fixing unit 40 includes a heating roller 41, which is heated by a heat source such as a halogen heater, and a counter roller 42, which is in a pressure contact with the heating roller 41. By conveying the sheet S in a sandwiched manner between the heating roller 41 and the counter roller 42 and by providing heat and pressure, the toner is fusion-bonded, and the image is fixed on the sheet S.

When the sheet S with the toner image fixed at the fixing unit 40 is delivered to a pair of sheet discharge rollers 46, the sheet S is discharged to a discharge tray 50. Also, in a case of a double-sided printing, at a branch conveyance portion 47 disposed between the fixing unit 40 and the pair of the sheet discharge rollers 46, the sheet S is guided toward a reverse conveyance unit 48, and is delivered to a duplex conveyance unit 49 with reversing a first surface (front surface) and a second surface (back surface) at the reverse conveyance unit 48. Then, the sheets S is conveyed to the pair of the registration rollers 39 by the duplex conveyance unit 49, and the toner image is transferred to the sheet S again at the secondary transfer portion T2. Thereafter, the toner image is fixed by the fixing unit 40, and the sheet S is discharged to the discharge tray 50.

Feeding Unit

Next, a configuration of the feeding unit 32 described above will be described in detail with reference to FIGS. 2 and 3. As described above, the feeding unit 32 includes the pickup roller 33, the feed roller 35, and the retard roller 36. These rollers, i.e. the pickup roller 33, the feed roller 35, and the retard roller 36, are driven by a feeding motor M1 which serves as a common driving motor to these rollers.

The feed roller 35 is a rotary feeding member to feed the sheet supported in the feed cassette 31, and includes a feed roller shaft 35*s* supported by a support frame 70 of the apparatus body 2 and a roller member 35*a* held by the feed roller shaft 35*s*. The roller member 35*a* is configured to integrally rotate with the feed roller shaft 35*s*, and the feed roller 35 is rotated by rotation of the feed roller shaft 35*s*.

The pickup roller 33 is supported by a pickup arm 33*b* which is rotatable around the feed roller shaft 35*s* above as a rotation center, and a pickup roller shaft 33*s* is supported at a tip portion of the pickup arm 33*b*. A roller member 33*a* of the pickup roller 33 is held by the pickup roller shaft 33*s*.

Furthermore, the retard roller 36 is arranged to face the feed roller 35, and, by abutting on the feed roller 35, becomes a rotary separation member which forms a separation nip 34N for conveying the sheet with separating the sheet into one by one. The retard roller 36 includes a retard roller shaft 36*s*, and a roller member 36*a*, which is held by the retard roller shaft 36*s* via a torque limiter 62.

At the time of feeding the sheet S, the feeding motor M1 drivingly rotates in a first direction in a state where the pickup roller 33 is abutting on the uppermost sheet of the sheet S supported on the sheet supporting portion 31*a* of the feed cassette 31 with the predetermined urging force. Hereupon, the pickup roller 33 is drivingly rotated in the sheet conveyance direction, and the sheet on the sheet supporting portion 31*a* is sent out to the separation nip 34N. When the feed motor M1 rotates in the first direction, the feed roller 35 is drivingly rotated in the sheet conveyance direction, same as the pickup roller 33. On the other hand, a driving force to drivingly rotate the retard roller 36 in a reverse direction to the sheet conveyance direction is input to the retard roller 36 via the torque limiter 62 as described above.

Therefore, in a state where the sheet S is not at the separation nip 34N or one sheet of the sheet S is being conveyed by the separation nip 34N, the torque limiter 62 slides and the retard roller 36 is rotated in the sheet conveyance direction which is the reverse direction to a rotational direction of the retard roller shaft 36*s*. On the other hand, when a plurality of the sheet S enter the separation nip 34N in overlapping, the retard roller 36 is rotated in a driven direction of the retard roller shaft 36*s*, and by a slide between overlapping sheets, the sheet S abutting on the feed roller 35 is conveyed in the sheet conveyance direction. Also, the sheet S abutting on the retard roller 36 is conveyed in a direction of returning to the feed cassette 31. In this manner, the sheet sent out to the separation nip 34N is conveyed with being separated into one by one, and is delivered to a pair of drawing rollers 37 for further transportation. The pair of drawing rollers 37 are drivingly rotated by a drawing motor M2, which is a different driving motor from the feeding motor M1.

As regard to the retard roller 36, which is the rotary separation member described above, the retard roller shaft 36*s*, which is the rotational shaft of the rotary separation member, is supported by an arm member 61, which is a support member, and is capable of swinging around a swing shaft 60, which is a center of a swing. In addition, the retard roller 36 is urged toward the feed roller 35 by an urging force of a compression spring 80 which is an urging member, and is in the pressure contact with the feed roller 35 by the urging force of the compression spring 80. To be noted, a pressure provided by the retard roller 36 toward the feed roller 35 for the pressure contact is hereinafter referred to as a "retard pressure", and the retard pressure is a parameter which affects a separation performance at the separation nip 34N. Although the compression spring 80 is applied to the urging member in this embodiment, any elastic body, for example, such as a rubber may be applied to configure the urging member.

Adjustment Mechanism

Figure 4:
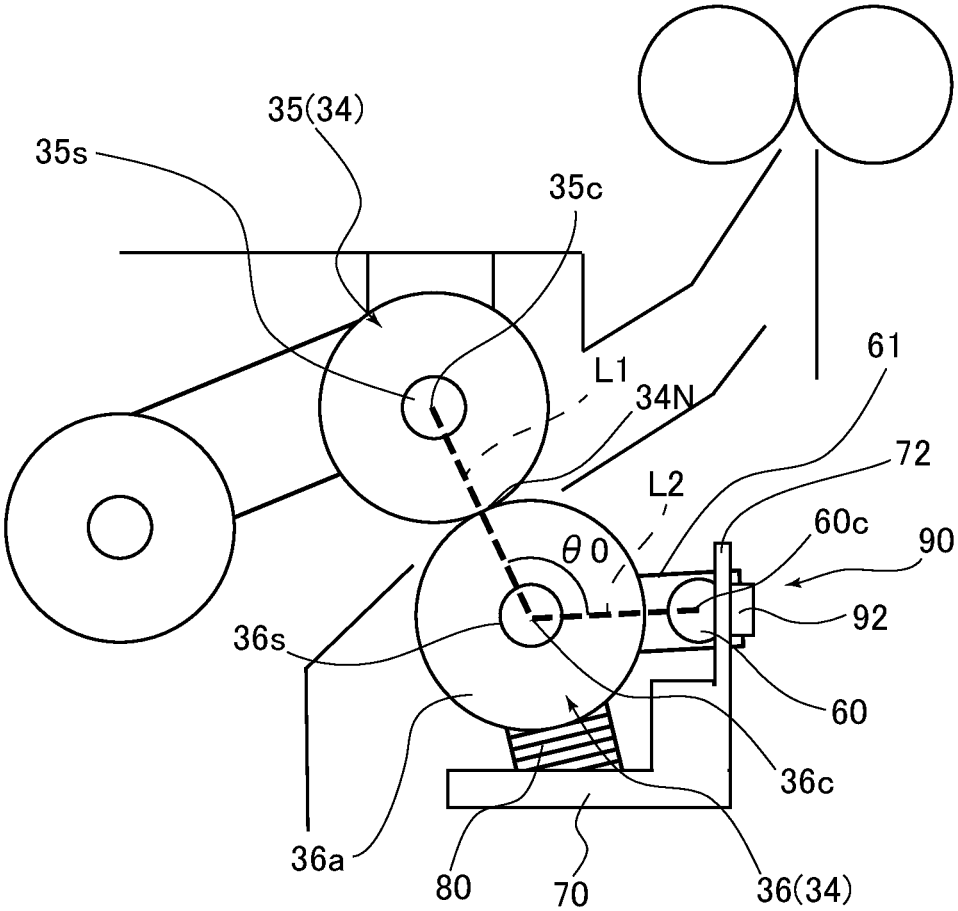
FIG. 4 is a schematic diagram showing positional relations among a feed roller, a retard roller, and a swing shaft.

FIG. 4 is a cross-sectional diagram of the feeding unit 32 cut in a plane perpendicular to the swing shaft 60 at the separation nip 34N. When the retard pressure described above is referred to as F, the retard pressure F is a resultant force of a force from the compression spring 80 and a moment of the arm member 61 generated at a time of a feeding drive. Incidentally, size of the moment of the arm member 61 at the time of the feeding drive changes with an angle Θ formed by a first imaginary line L1 and a second imaginary line L2 in FIG. 4. To be noted, the first imaginary line L1 is an imaginary line connecting a rotation center 35*c* of the feed roller 35 and a rotation center 36*c* of the retard roller 36, and the second imaginary line L2 is the imaginary line connecting the rotation center 36*c* of the retard roller 36 and an axial center 60*c* of the swing shaft 60.

Therefore, although each of the feed roller shaft 35*s*, the retard roller shaft 36*s*, and the swing shaft 60 is supported by the support frame 70 in a manner where the angle Θ described above is equal to a design angle $\Theta_0$, there are cases where the angle Θ is not equal to $\Theta_0$ due to the tolerance of the component and inaccuracy of the assembly. Then, in a case where Θ is larger than $\Theta_0$, the retard pressure becomes larger than a design retard pressure ($F>F_0$). Also, in a case where Θ is smaller than $\Theta_0$, the retard pressure becomes smaller than the design retard pressure ($F<F_0$).

Therefore, the feeding unit 32 according to this embodiment includes an adjustment mechanism 90 which enables to adjust relative positional relations among the rotation center 35*c* of the feed roller 35, the rotation center 36*c* of the retard roller 36, and the axial center 60*c* of the swing shaft 60. The adjustment mechanism 90 will be described in detail below. To be noted, by variances of shaft positions described above, the urging force also alters due to a change in length of the compression spring 80. However, since an impact of the change in the spring length on the retard pressure is adequately small as compared with the impact of the variance in the angle Θ, the impact of the change in the spring length is considered negligible herein.

Figure 2:
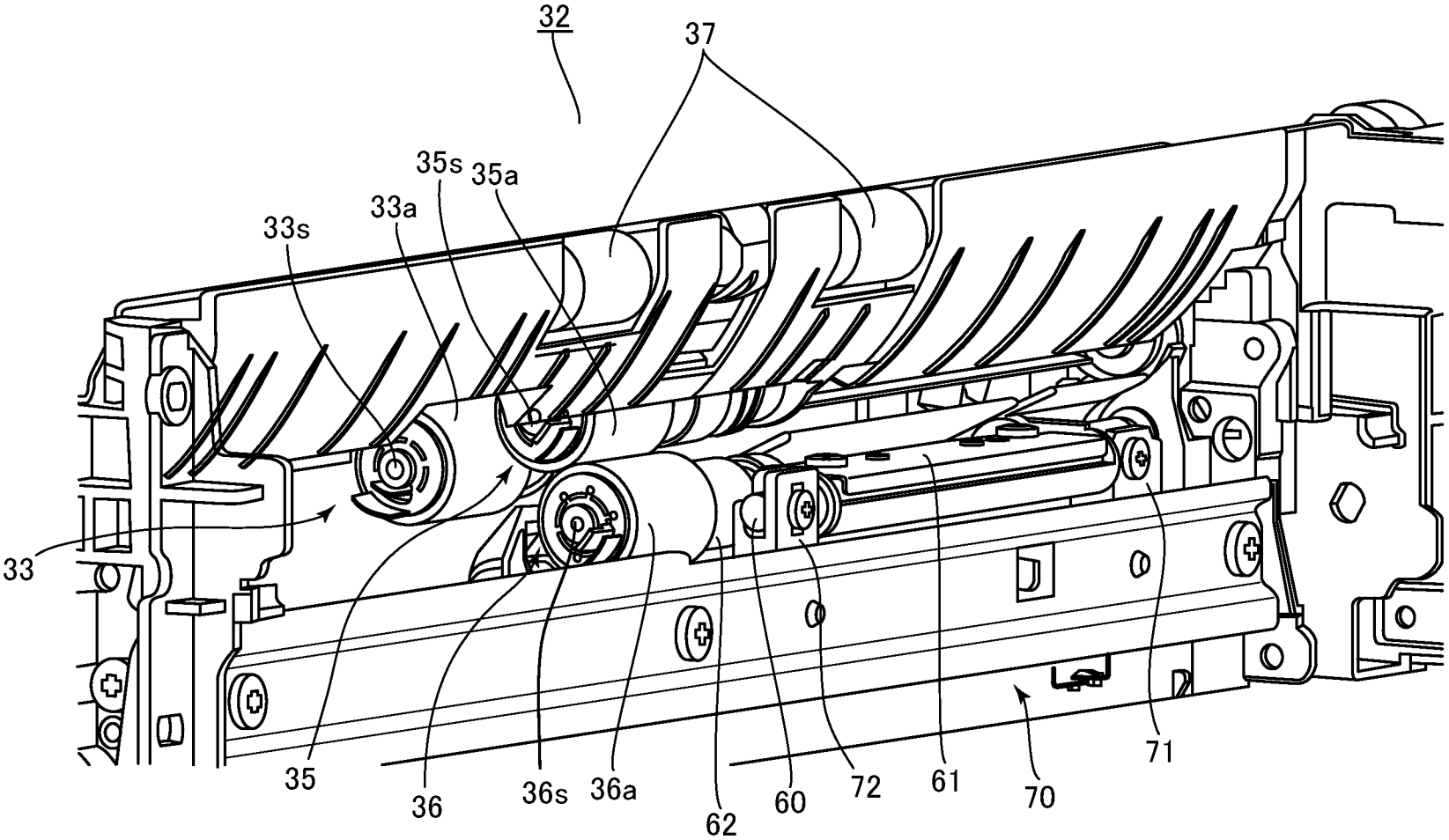
FIG. 2 is a partial perspective view of a sheet feeding unit.
Figure 3:
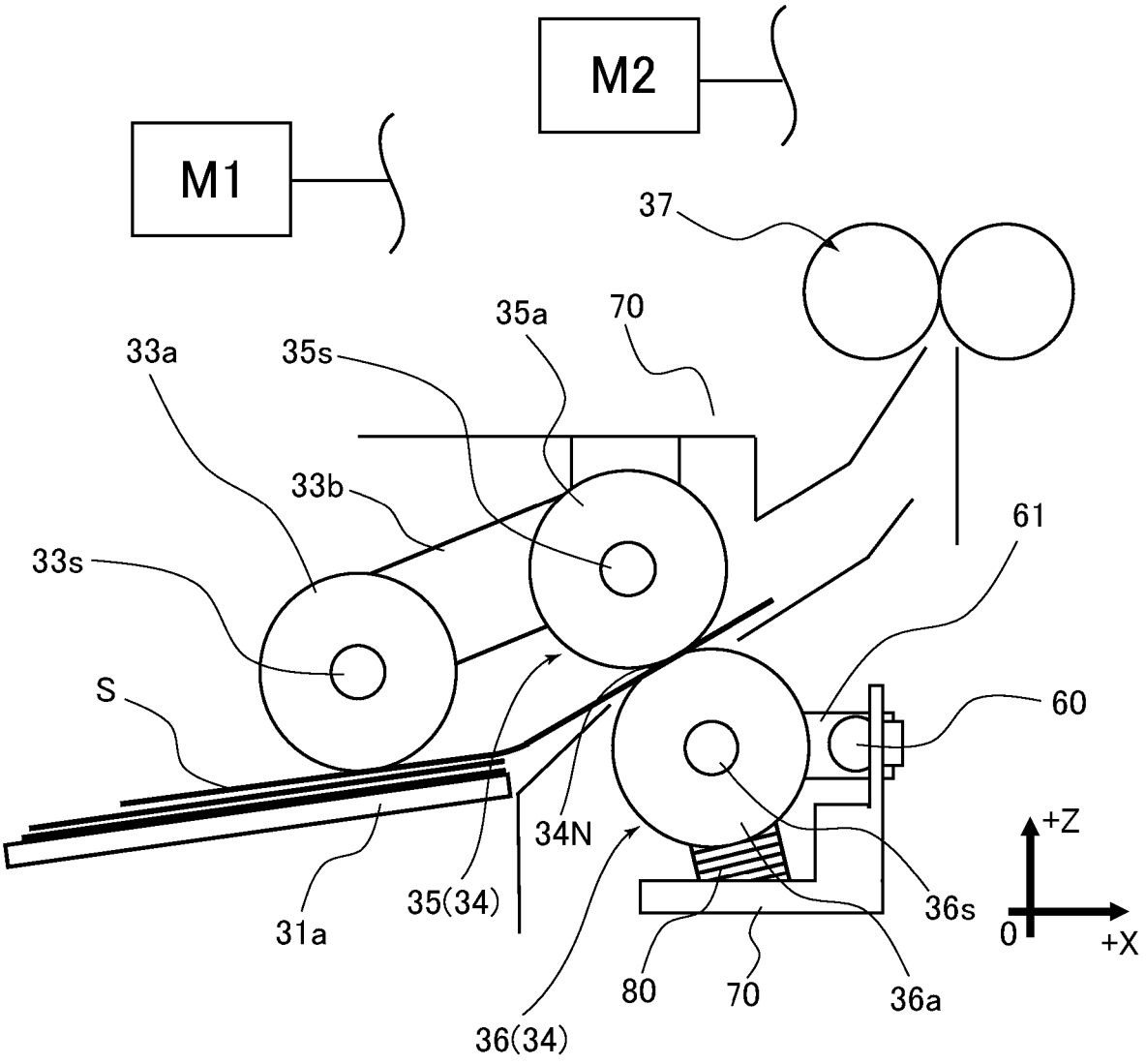
FIG. 3 is a schematic diagram of the sheet feeding unit.
Figure 5:
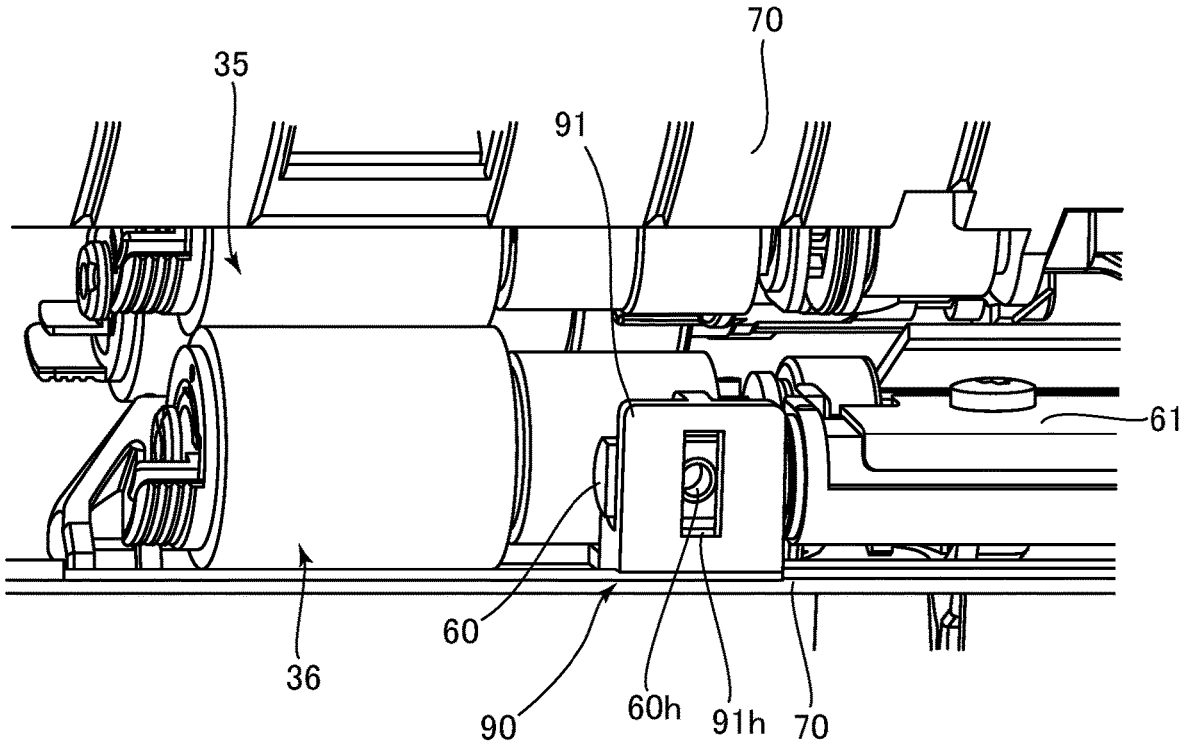
FIG. 5 is a diagram showing an adjustment mechanism.

A first end portion of the swing shaft 60 is, as illustrated in FIG. 2, fixed to a first support portion 71 of the support frame 70, and also a second end portion of the swing shaft 60 at an opposite side of the first end portion in an axial direction is movably supported by a second support portion 72 of the support frame 70. Specifically, as illustrated in FIG. 5, the support frame 70 is a frame member to fix the swing shaft 60 which supports the arm member 61 in a manner of being capable of swinging, and supports from below the second end portion of the swing shaft 60 by the second support portion 72 formed in U-shape. Therefore, the second end portion of the swing shaft 60 is movable within the second support portion 72 in a vertical direction in FIG. 2.

Also, a wall member 91 is placed upright facing the swing shaft 60 described above in a direction orthogonal to the axial direction of the swing shaft 60, and a long hole 91*h* which is long in the vertical direction is formed in the wall member 91. Furthermore, a screw hole 60*h* is provided in the swing shaft 60 at a position facing the long hole 91*h* described above, and the wall member 91 fixes the swing shaft 60 with a captive screw 92, which is a fixing member, so that a height position of the swing shaft 60 is changeable within a limit of the long hole 91*h*.

That is, the adjustment mechanism 90 includes the wall member 91 having the long hole 91*h* described above and the screw hole 60*h*, and enables to fix the swing shaft 60 at a plurality of positions to the supporting frame 70. Specifically, the captive screw 92 described above and the long hole 91*h* are positioning members which determine the position of the second end portion of the swing shaft 60 at the second support portion 72, these positioning members enable to change the position of the swing shaft 60. When the angle Θ deviates from the design angle Θ due to the variances of the component and the assembly, it is possible to bring the retard pressure F near to the design retard pressure $F_0$ by changing a fixing position of the swing shaft 60 to the supporting frame 70 by use of the adjustment mechanism 90.

Figure 6A:
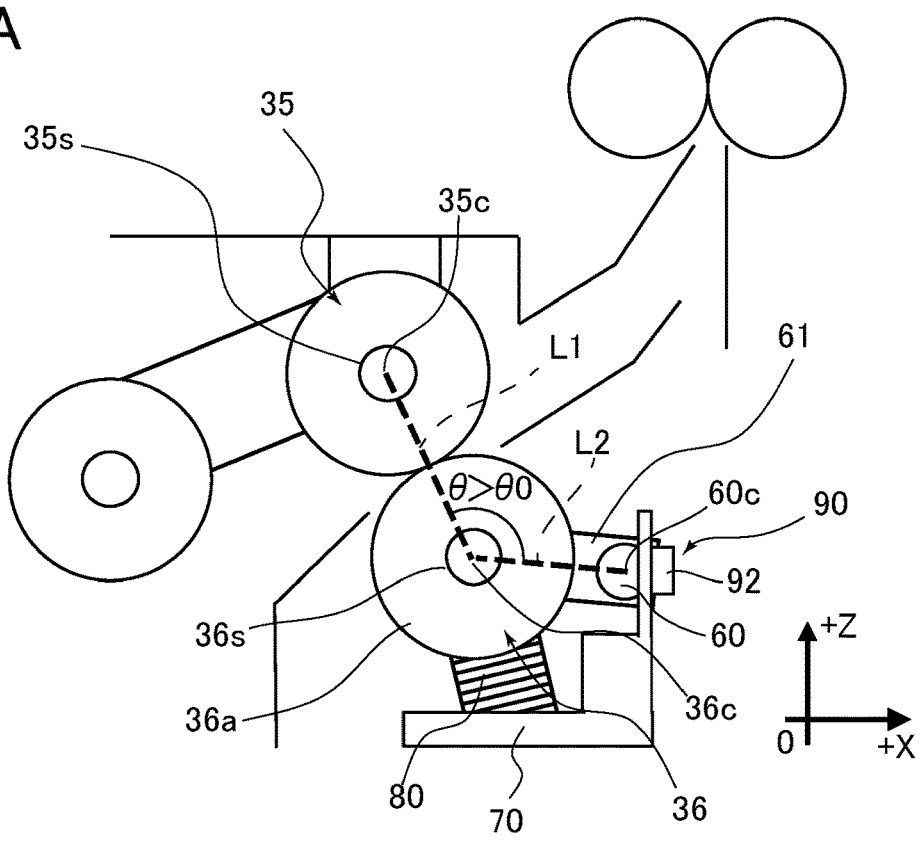
FIG. 6A is a diagram showing the sheet feeding unit in a state of $\Theta>\Theta_0$.
Figure 6B:
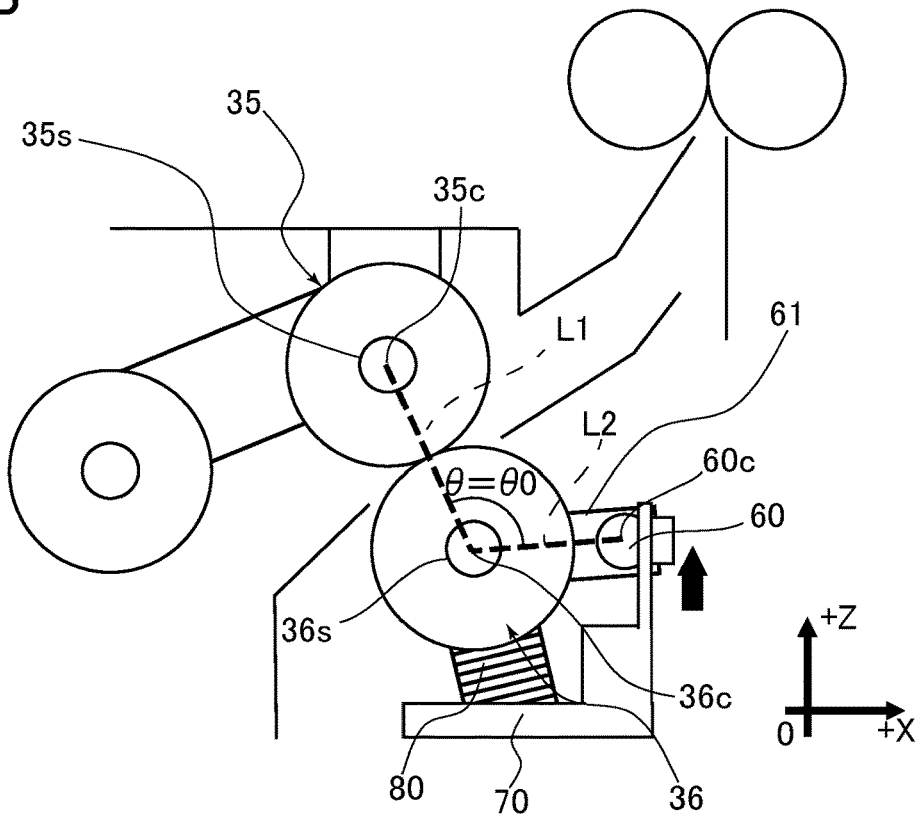
FIG. 6B is a diagram showing the sheet feeding unit in the state of $\Theta=\Theta_0$.
Figure 7A:
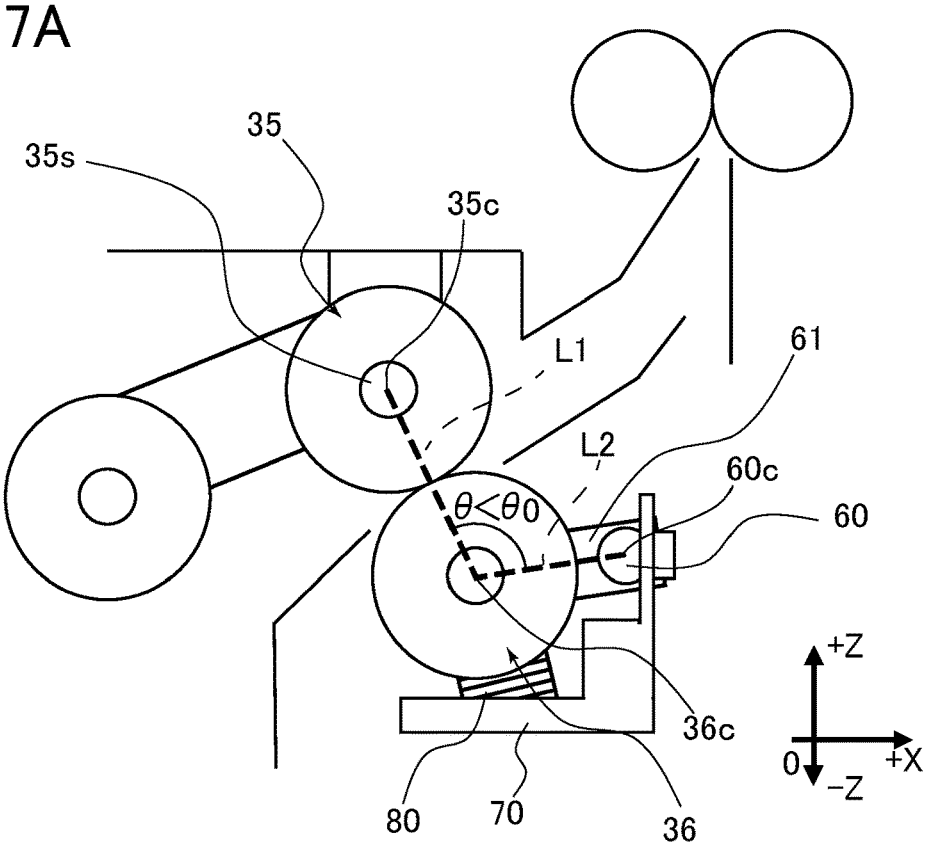
FIG. 7A is a diagram showing the sheet feeding unit in the state of $\Theta<\Theta_0$.
Figure 7B:
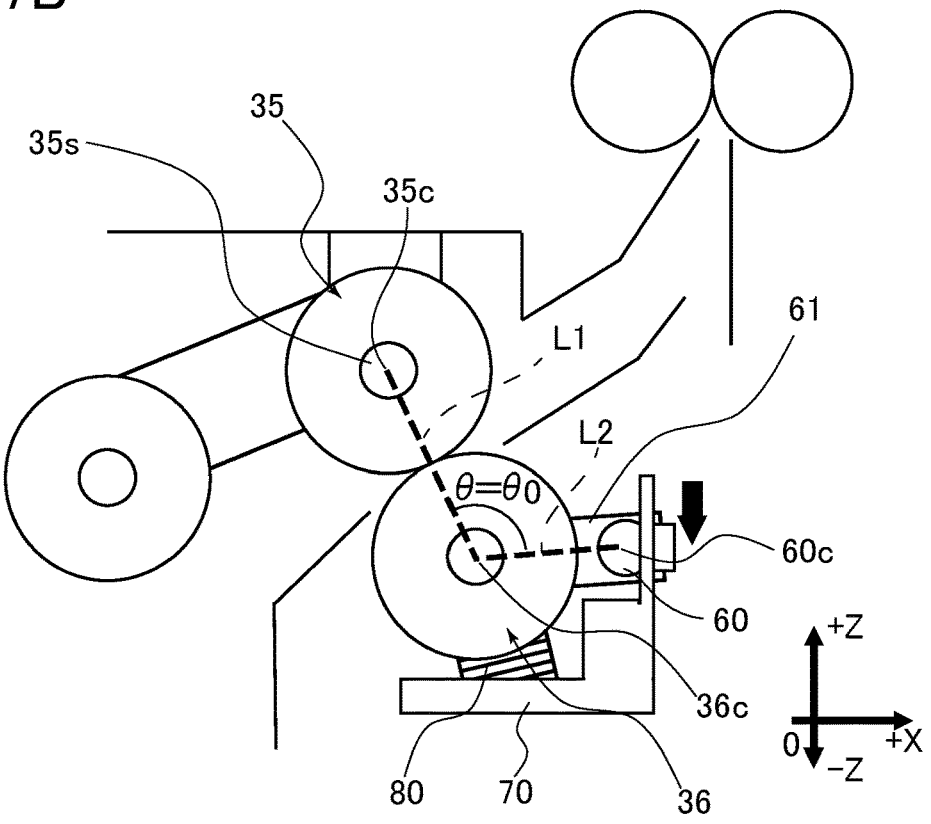
FIG. 7B is a diagram showing the sheet feeding unit in the state of $\Theta=\Theta_0$.

For example, in a case, as shown in FIG. 6A, where Θ is larger than $\Theta_0$ and the retard pressure F is larger than the design value $F_0$, as illustrated in FIG. 6B, the swing shaft 60 is moved in a direction of +Z and fixed at a position of Θ being equal to $\Theta_0$. It is possible to correct positional relations among the feed roller 35, the retard roller 36, and the swing shaft 60 by this adjustment, and adjust the retard pressure F equal to $F_0$. On the other hand, in a case, as shown in FIG. 7A, where Θ is smaller than Θ and the retard pressure F is smaller than the design value $F_0$, as illustrated in FIG. 7B, the swing shaft 60 is moved in a direction of −Z and fixed at a position of Θ being equal to $\Theta_0$. It is possible to correct the positional relations among the feed roller 35, the retard roller 36, and the swing shaft 60 by this adjustment, and adjust the retard pressure F equal to $F_0$.

Figure 8:
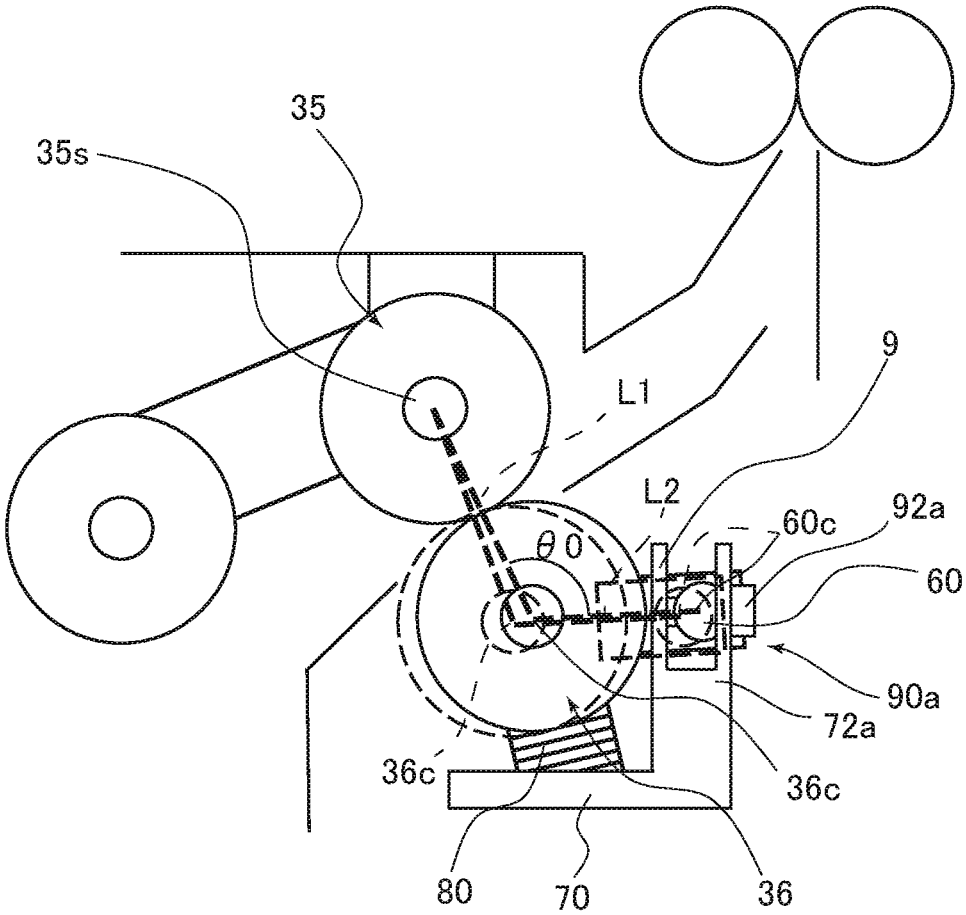
FIG. 8 is a diagram showing another example of the sheet feeding unit.

To be noted, although the swing shaft 60 is fixable at the plurality of positions which are different in the vertical direction in the embodiment describe above, the swing shaft 60 may be configured to be fixable at the plurality of positions in a crosswise direction of FIG. 6. For example, as shown in FIG. 8, the position of the swing shaft 60 may be configured to be changeable by making the relative position of the swing shaft 60 screwed with the captive screw 92*a* changeable in an axial direction of the captive screw 92*a* in a configuration where the second support portion 72*a* supports the swing shaft 60 movable in the crosswise direction. Furthermore, it is acceptable to configure the adjustment mechanism being capable to move the swing shaft 60 in both vertical and crosswise directions.

That is, it is acceptable to move the swing shaft 60 in any direction, not limited to the direction of Z, to adjust the angle Θ described above. Also, although, in this embodiment, the angle Θ described above is changed by changing a phase between the first end portion and the second end portion, it is not limited to this, and acceptable to configure the adjustment mechanism to move the swing shaft 60 in a parallel direction. In addition, the swing shaft 60 is fixed with the captive screw 92 (92*a*) in the embodiment described above, it is not limited to this. For example, the adjustment mechanism may be configured to change and fix the fixing position of the swing shaft 60 with various methods such as a pin, a slide mechanism, and a rack mechanism.

As described above, since the swing shaft 60 is fixable at the plurality of positions to the supporting frame 70 in this embodiment, it is possible to adjust the angle Θ formed between the first imaginary line L1 and the second imaginary line L2. In particular, by changing the fixing position of the swing shaft 60 in the vertical direction (direction of Z), the angle of inclination of the second imaginary line L2 against the first imaginary line L1 is changed, and an adjustment of the angle Θ described above is enabled. That is, in this embodiment, the adjustment mechanism is configured to enable to fix the swing shaft 60 at the plurality of the positions in the vertical direction to the frame member 70. In addition, it is possible to adjust the angle Θ described above by changing the fixing position of the swing shaft 60 in the crosswise direction (direction of X) and changing the angle of the inclination of the first imaginary line L1 against the second imaginary line L2. That is, in a case where the crosswise direction (direction of X) is the direction orthogonal to the vertical direction and the axial direction of the swing shaft 60, it is acceptable to configure the adjustment mechanism to be capable of fixing the swing shaft 60 in the plurality of the positions to the frame member 70 in the crosswise direction. As described above, by fixing the swing shaft 60 at the plurality of positions in the directions of Z and/or the direction of X in FIGS. 3, 6 and 7 to the frame member 70, it is possible to fix the swing shaft 60 at the plurality of the positions with the different angle Θ described above.

Therefore, it is possible to adjust the relative positional relations among the rotary feed member (the feed roller), the rotary separation member (the retard roller), and the swing shaft, and possible to adjust the pressure of the pressure contact (the retard pressure) of the rotary separation member to the rotary feed member. Also, for example, in a case where the angle Θ described above deviates from the design angle $\Theta_0$ at a time of a product shipment due to the tolerance of the component and inaccuracy in the assembly, it is possible to adjust the angle Θ so as to bring the retard pressure F to the design value $F_0$, and suppress the variance of the retard pressure. Also, in a case where the retard pressure has changed by wear of rollers during use, a service person and the like can adjust the retard pressure by adjusting the angle Θ described above. Specifically, since in this embodiment it is possible to adjust the position of the second end portion of the swing shaft 60 continuously (lineally) within the limit of the length of the long hole 91*h* and is possible to adjust the retard pressure F lineally, it is attainable to accurately bring the retard pressure F near to the design target value $F_0$. To be noted, in this case, the angle Θ described above is adjusted to deviate from the design angle $\Theta_0$. Furthermore, for example, if the adjustment mechanism is configured to automatically change the position of the swing shaft 60 by use of a driving power source such as a motor and a solenoid, it is possible to change the retard pressure in accordance with a type of the sheet and a feeding environment.

In addition, although an impact of the angle Θ described above on the retard pressure F becomes the greater the smaller a diameter of the retard roller 36 is, it is possible to decrease the design diameter of the retard roller 36 since the angle Θ is adjustable in a case of this embodiment. Accordingly, it is possible to improve a degree of freedom at the design, and is also possible to pursue a reduction of apparatus size and costs.

Second Embodiment

Next, a second embodiment of the present invention will be described. To be noted, the second embodiment is different from the first embodiment only in a supporting method of the swing shaft 60. Therefore, description will be given only to different aspects from the first embodiment, and the description of other aspects will be omitted herein by putting a same mark as in the first embodiment.

Figure 9:
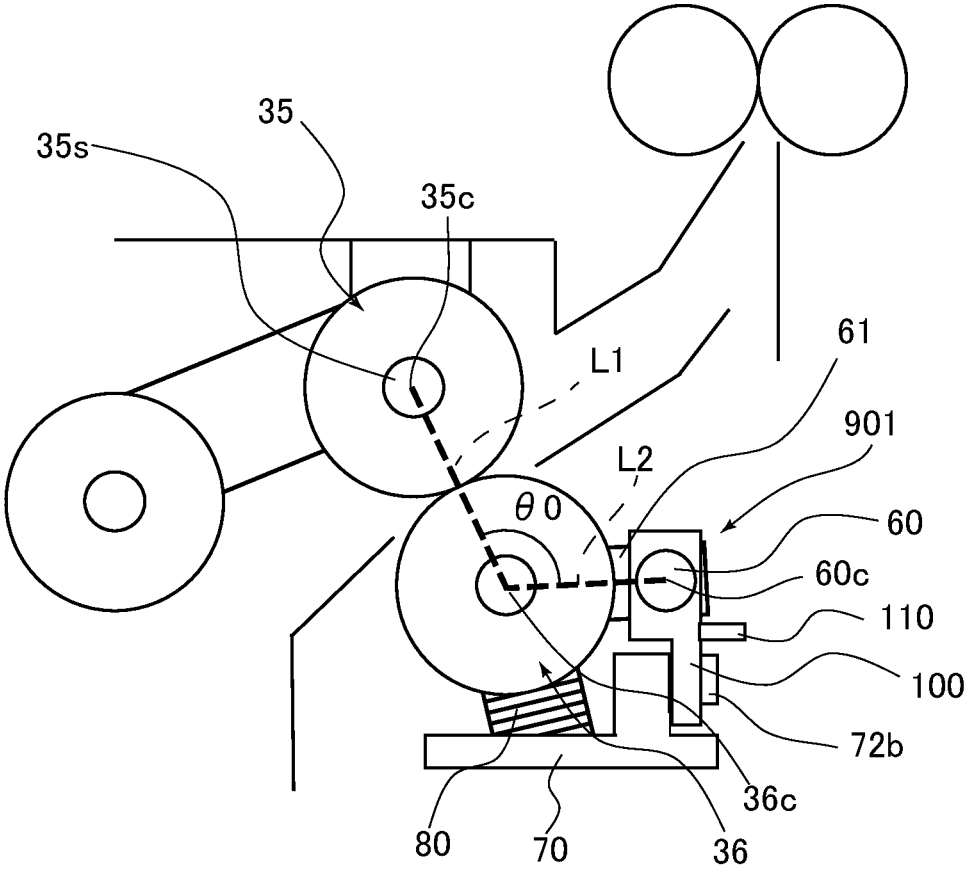
FIG. 9 is a diagram showing a sheet feeding unit according to a second embodiment.

As illustrated in FIG. 9, an adjustment mechanism 901 includes a holder 100 which is a holding member to hold the second end portion of the swing shaft 60, and the holder 100 movably holds the second support portion 72*b* of the support frame 70 in the plurality of positions. The holder 100 is provided with a control lever 110 for a worker to manipulate the holder 100, and the worker is able to move the holder 100 in the vertical direction to the second support portion 72*b* by shifting the control lever 110 by gripping with hands. Specifically, it is possible to move the holder 100 described above continuously in the vertical direction via a rail mechanism provided between the holder 100 and the support frame 70, and is possible to fix the holder 100 at a desired position by use of a lock mechanism which is manipulated with the control lever 110. When the position of the second support portion 72*b* to the holder 100 is determined, the holder 100 is fixed to the support frame 70 with the fixing member (for example, the captive screw) similar to the first embodiment.

Figure 10A:
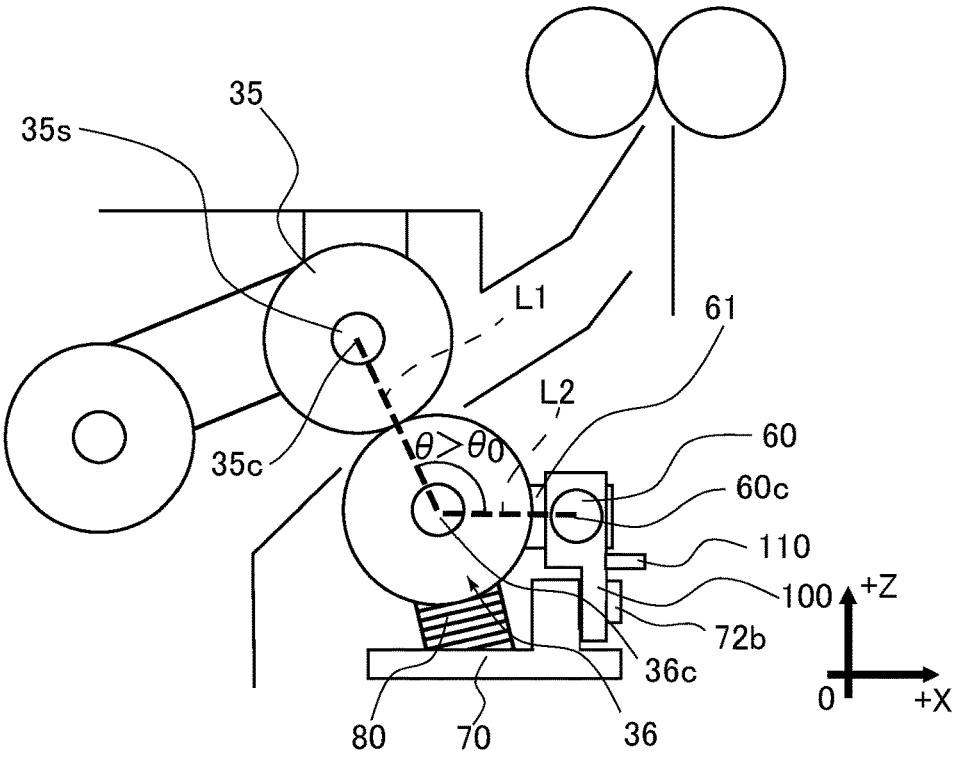
FIG. 10A is a diagram showing the sheet feeding unit in the state of $\Theta>\Theta_0$.
Figure 10B:
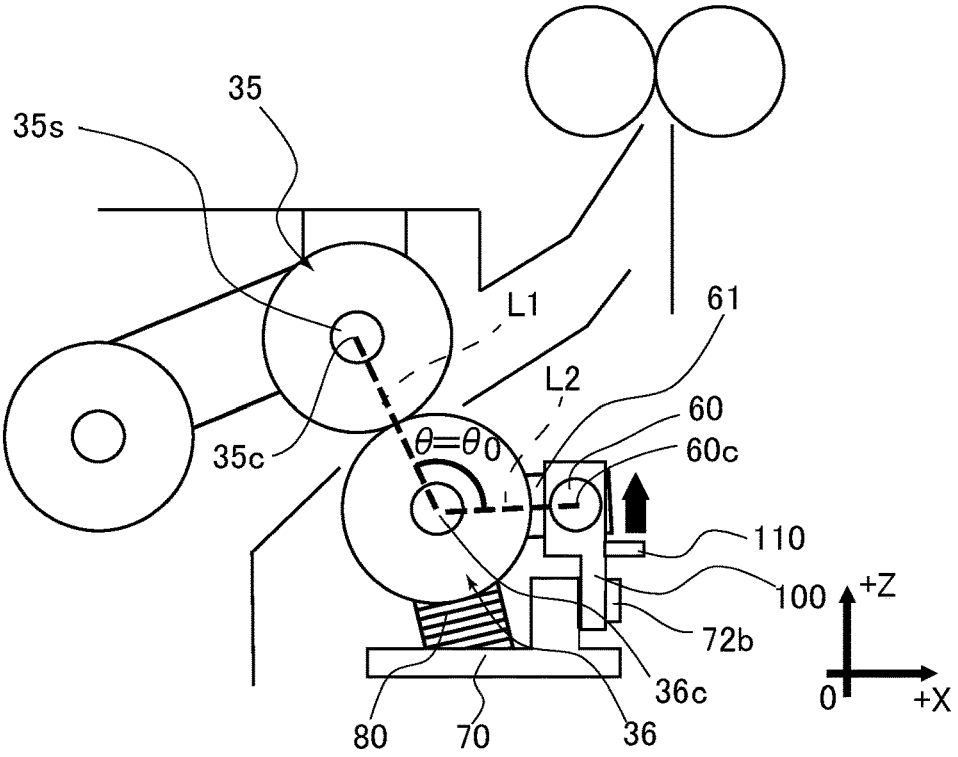
FIG. 10B is a diagram showing the sheet feeding unit in the state of $\Theta=\Theta_0$.
Figure 11A:
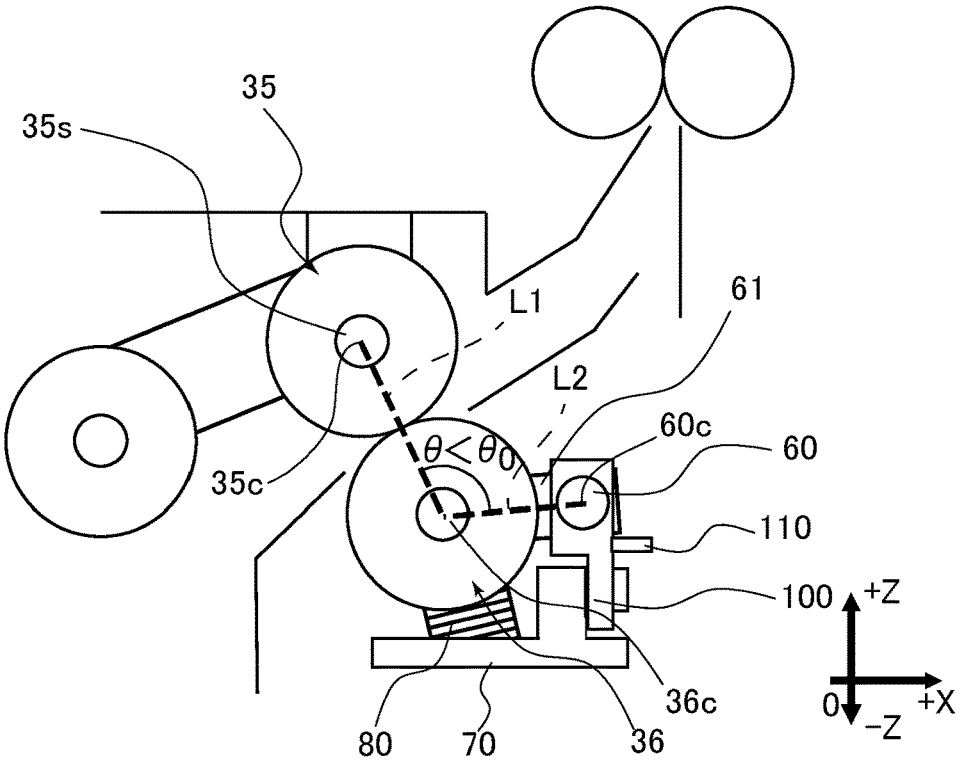
FIG. 11A is a diagram showing the sheet feeding unit in the state of $\Theta<\Theta_0$.
Figure 11B:
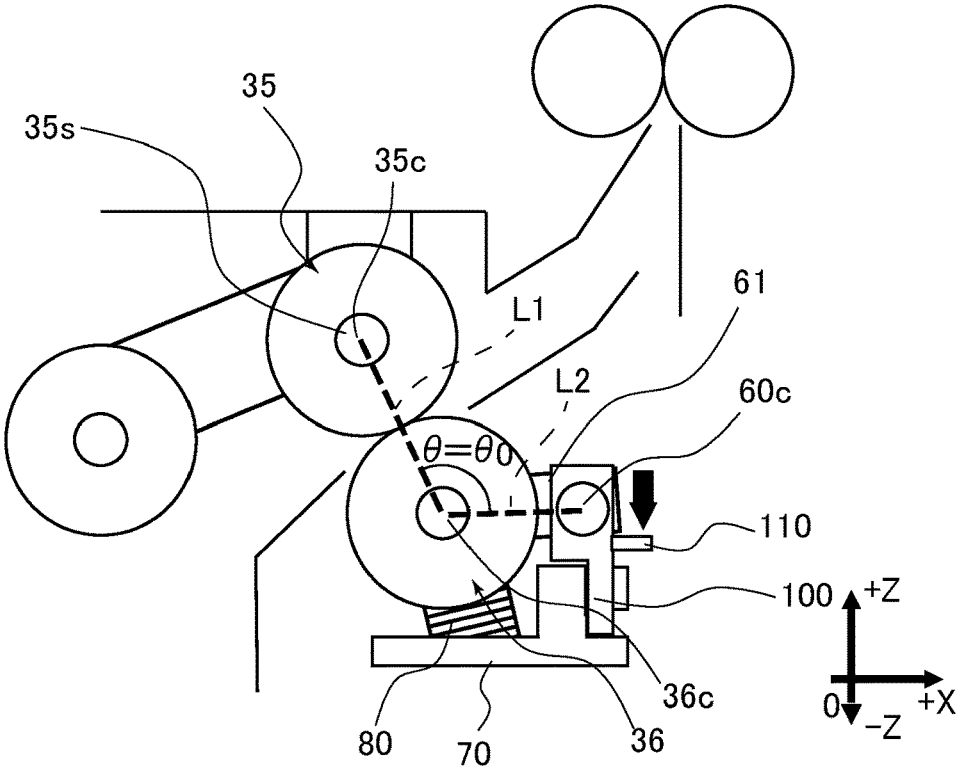
FIG. 11B is a diagram showing the sheet feeding unit in the state of $\Theta=\Theta_0$.

In particular, for example, in a case where Θ is larger than $\Theta_0$ as shown in FIG. 10A and the retard pressure F is larger than the design value $F_0$, the holder 100 is moved in the direction of +Z as shown in FIG. 10B and fixed at the position of Θ being equal to $\Theta_0$. By this adjustment, it is possible to correct the positional relations among the feed roller 35, the retard roller 36, and the swing shaft 60, and is possible to adjust the retard pressure F equal to $F_0$. On the other hand, in a case where Θ is smaller than $\Theta_0$ as shown in FIG. 11A and the retard pressure F is smaller than the design value $F_0$, the holder 100 is moved in the direction of −Z as shown in FIG. 11B and fixed at the position of Θ being equal to $\Theta_0$. By this adjustment, it is possible to correct the positional relations among the feed roller 35, the retard roller 36, and the swing shaft 60, and possible to adjust the retard pressure F equal to $F_0$.

As described above, by configuring the holder 100 to support the second end portion of the swing shaft 60 and providing the holder 100 with the control lever 110, the worker is able to easily adjust the position of the swing shaft 60. To be noted, similar to the first embodiment, any fixing methods or any moving directions are acceptable for fixing or moving of the holder 100 to the support frame 70.

Furthermore, although an example of adjusting the position of the swing shaft 60 to the support frame 70 is described in the embodiment described above, it is, for example, acceptable to adjust the angle Θ by changing the position of the support frame 70 to the apparatus body 2. In this case, the adjustment mechanism moves the position of the swing shaft 60 by collectively moving a retard roller unit, and the apparatus body 2 becomes the frame member to which the swing shaft 60 is fixed via the support frame 70.

Also, although the retard roller which is input to be drivingly rotated in the reverse direction to the feed roller is described as an example of the rotary separation member in the embodiment described above, the present invention is not limited to this. For example, the retard roller configured to stop rotation with a one-way clutch which engages in a case of the plurality of the sheets entering into the separation nip 34N is also acceptable as the rotary separation member. Furthermore, in the embodiment as described above, the sheet feeding unit which feeds the sheet from the feed cassette 31 to the image forming unit 10 is described as an example of the application, the present invention is not limited to this. For example, the present invention is applicable to the sheet feeding unit feeding the sheet to an image reading unit which reads an image in an image reading apparatus such as a scanner. In addition, the present invention is also applicable to the sheet feeding unit which feeds the sheet from a manual feed tray to the image forming unit. Furthermore, the present invention is applicable to the sheet feeding unit of a various image forming apparatus such as a facsimile and an ink jet printer. In addition, the inventions in the embodiments described above may be combined in any forms.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-089433, filed May 10, 2019, which is hereby incorporated by reference herein in its entirety.

What is claimed is:

1. A sheet feeding apparatus comprising:

a sheet supporting portion configured to support a sheet;

a rotary feeding member configured to feed the sheet supported on the sheet supporting portion;

a rotary separation member configured to abut on the rotary feeding member and form a separation nip in which the sheet is conveyed with separating from another sheet;

a support member configured to support a rotation shaft of the rotary separation member;

a swing shaft configured to support the support member with the support member being swingable;

an urging member configured to urge the rotary separation member toward the rotary feeding member;

a frame member comprising a fixed first support portion configured to fix a first end portion of the swing shaft so the first end portion is not linearly movable and a second support portion configured to movably support a second end portion of the swing shaft, the second support portion being located at a position closer to the rotary separation member than the first support portion in an axial direction of the swing shaft; and an adjustment mechanism comprising an extended opening formed in the second support portion and a fixing member configured to fix the second end portion of the swing shaft to the frame member through the extended opening, wherein the extended opening extends in a vertical direction with respect to the axial direction of the swing shaft so the second end portion of the swing shaft can be fixed at a plurality of positions which vary in the vertical direction to the second support portion with the fixing member while the first end portion of the swing shift is not movable in the vertical direction.

2. The sheet feeding apparatus according to claim 1, wherein the adjustment mechanism can fix the second end portion of the swing shaft at the plurality of the positions where angles between a first imaginary line and a second imaginary line are different in a state in which the rotary separation member abuts the rotary feeding member, the first imaginary line being an imaginary line connecting a rotation center of the rotary feeding member and a rotation center of the rotary separation member in a cross-section perpendicular to the swing shaft at the separation nip, the second imaginary line being an imaginary line connecting the rotation center of the rotary separation member and an axial center of the swing shaft in the cross-section perpendicular to the swing shaft at the separation nip.

3. The sheet feeding apparatus according to claim 2, wherein the adjustment mechanism can fix the swing shaft to the frame member at the plurality of the positions where the second imaginary line is inclined to different angles.

4. The sheet feeding apparatus according to claim 1, wherein, in a case of a crosswise direction being a direction orthogonal to a vertical direction and an axial direction of the swing shaft, the adjustment mechanism can fix the swing shaft to the frame member at the plurality of the positions which are different in the crosswise direction.

5. An image forming apparatus comprising:

the sheet feeding apparatus according to claim 1; and an image forming unit to form an image on the sheet fed by the sheet feeding apparatus.

6. The sheet feeding apparatus according to claim 1, wherein the fixed member is a screw, and the swing shaft is provided with a screw hole corresponding to the screw, the swing shaft is fixed to the frame member by the screw.

7. The sheet feeding apparatus according to claim 1, wherein the second support portion includes a wall member facing the swing shaft and the extended opening is formed in the wall member in such a manner that the extended opening penetrates the wall in a direction orthogonal to the axial direction of the swing shaft.

8. A sheet feeding apparatus comprising:

a sheet supporting portion configured to support a sheet;

a rotary feeding member configured to feed the sheet supported on the sheet supporting portion;

a rotary separation member configured to abut on the rotary feeding member and form a separation nip in which the sheet is conveyed with separating from another sheet;

a support member configured to support a rotation shaft of the rotary separation member;

a swing shaft configured to support the support member with the support member being swingable;

an urging member configured to urge the rotary separation member toward the rotary feeding member;

a frame member comprising a fixed first support portion configured to fix a first end portion of the swing shaft so the first end portion is not linearly movable and a second support portion configured to movably support a second end portion of the swing shaft, the second support portion being located at a position closer to the rotary separation member than the first support portion in an axial direction of the swing shaft; and an adjustment mechanism configured to fix the second end portion of the swing shaft at the plurality of the positions where a first imaginary line is inclined to different angles so that angles between the first imaginary line and a second imaginary line are different in a state in which the rotary separation member abuts the rotary feeding member while the first end portion of the swing shift is not movable in a moving direction of the second end portion, the first imaginary line being an imaginary line connecting a rotation center of the rotary feeding member and a rotation center of the rotary separation member in a cross-section perpendicular to the swing shaft at the separation nip, the second imaginary line being an imaginary line connecting the rotation center of the rotary separation member and an axial center of the swing shaft in the cross-section perpendicular to the swing shaft at the separation nip.

9. A sheet feeding apparatus comprising:

a sheet supporting portion configured to support a sheet;

a rotary feeding member configured to feed the sheet supported on the sheet supporting portion;

a rotary separation member configured to abut on the rotary feeding member and form a separation nip in which the sheet is conveyed with separating from another sheet;

a support member configured to support a rotation shaft of the rotary separation member;

a swing shaft configured to support the support member with the support member being swingable;

an urging member configured to urge the rotary separation member toward the rotary feeding member;

a frame member comprising a fixed first support portion configured to fix a first end portion of the swing shaft so the first end portion is not linearly movable and a second support portion configured to movably support a second end portion of the swing shaft, the second support portion being located at a position closer to the rotary separation member than the first support portion in an axial direction of the swing shaft; and an adjustment mechanism that can continuously change a position to which the second end portion of the swing shaft is fixed with the frame member within a predetermined range while the first end portion of the swing shift is not movable in a moving direction of the second end portion, wherein an angle between a first imaginary line and a second imaginary line in a state in which the rotary separation member abuts the rotary feeding member is changed according to the position to which the second end portion of the swing shaft is fixed with the frame member, the first imaginary line being an imaginary line connecting a rotation center of the rotary feeding member and a rotation center of the rotary separation member in a cross-section perpendicular to the swing shaft at the separation nip, the second imaginary line being an imaginary line connecting the rotation center of the rotary separation member and an axial center of the swing shaft in the cross-section perpendicular to the swing shaft at the separation nip.

10. The sheet feeding apparatus according to claim 9, wherein the adjustment mechanism is configured to continuously change the position to which the swing shaft is fixed with the frame member in such a manner that an inclination of the second imaginary line changes.

11. The sheet feeding apparatus according to claim 10, wherein the adjustment mechanism comprises an extended opening formed in the second support portion and a fixing member configured to fix the second end portion of the swing shaft to the frame member through the extended opening, and the extended opening is extended in a vertical direction with respect to the axial direction of the swing shaft and the position to which the swing shaft is fixed with the frame member is changed within a range of the extended opening.

12. The sheet feeding apparatus according to claim 10, wherein the adjustment mechanism comprises a holder configured to hold the second end portion of the swing shaft in such a manner that the holder can move in a vertical direction with respect to the second support portion within the predetermined range, and a lever for moving the holder.

13. The sheet feeding apparatus according to claim 9, wherein in a case of a crosswise direction being a direction orthogonal to a vertical direction and the axial direction of the swing shaft, the adjustment mechanism is configured to continuously change the position to which the swing shaft is fixed with the frame member in the crosswise direction.

* * * * *